United States Patent [19]

Murakami et al.

[11] Patent Number: 4,651,663

[45] Date of Patent: Mar. 24, 1987

[54] DEVICE FOR SETTING STITCHING CONDITIONS IN AN ELECTRONIC CONTROL SEWING MACHINE

[75] Inventors: Eiji Murakami; Toru Hyodo, both of Tokyo; Haruhiko Tanaka, Mitaka, all of Japan

[73] Assignee: Janome Sewing Machine Co., Ltd., Tokyo, Japan

[21] Appl. No.: 681,212

[22] Filed: Dec. 12, 1984

[30] Foreign Application Priority Data

Dec. 14, 1983 [JP] Japan ..... 58-234178

[51] Int. Cl.[4] ..... D05B 3/02

[52] U.S. Cl. ..... 112/458; 112/456

[58] Field of Search ..... 112/158 E, 158 F, 121.11, 112/121.12, 458, 454, 453, 456, 457, 445

[56] References Cited

U.S. PATENT DOCUMENTS

| | | | |
|---|---|---|---|
| 4,122,786 | 10/1978 | Tanimoto et al. | 112/454 |
| 4,177,744 | 12/1979 | Wurst et al. | 112/158 E |
| 4,236,467 | 12/1980 | Tanaka et al. | 112/158 F X |
| 4,275,674 | 6/1981 | Carbonato et al. | 112/458 X |
| 4,280,423 | 7/1981 | Goncharko | 112/158 F X |
| 4,413,574 | 11/1983 | Hirota et al. | 112/458 X |
| 4,499,836 | 2/1985 | Meier et al. | 112/458 X |
| 4,502,402 | 3/1985 | Kato | 112/158 E |

*Primary Examiner*—Peter Nerbun

*Attorney, Agent, or Firm*—Michael J. Striker

[57] ABSTRACT

A stitch condition setting device for an electronically controlled sewing machine that forms stitch patterns and has a reciprocating needle, a fabric feed and an electronic memory to store stitch control signals, the stitch condition setting device having an apparatus for separately designating a change in a needle amplitude amount and a fabric feed amount in accordance with a selected stitch pattern, an apparatus for switching the designating apparatus between designating the change in needle amplitude amount and designating the change in fabric feed amount; and an apparatus responsive to the designating apparatus and the switching apparatus for changing the needle amplitude amount and the fabric feed amount in accordance with the selected stitch pattern.

9 Claims, 2 Drawing Figures

Ⓓ Pattern selection

Ⓔ Amplitude setting

Ⓕ Feed setting

Ⓖ Basic line of straight pattern

17: Switch device
23,36,39,33: Decoder
19,20: Encoder
34,37,32,21: Latch
24: Pattern data memory
18: Pattern number memory
25: Auto data memory
26: Pattern data calculator
44: Pattern forming device

DEVICE FOR SETTING STITCHING CONDITIONS IN AN ELECTRONIC CONTROL SEWING MACHINE

FIELD OF THE INVENTION

This invention relates to a device for setting of stitching conditions in an electronic control sewing machine which forms stitched patterns.

BACKGROUND OF THE INVENTION

In such a sewing machine which controls amounts of needle amplitude and amounts of fabric feed per each of operations of a key, it is not preferable to finely divide changing amounts of controls with respect to a unit operation in order to obtain a determined control through a lesser number of operations. However, on the other hand, fine controls are required as the controlling functions. In the conventional electronic control sewing machine, these two requirements have not been satisfied.

SUMMARY OF THE INVENTION

It is an object of the present invention to provide a device to designate quantitatively the amount of the needle amplitude and the amount of the fabric feed by a keyboard. Functions of the keyboard are switched to designation of the needle amplitude amount and to designation of the fabric feed amount by means of a switch designating key. The keyboard is operated, for example, twice so that the needle amplitude amount or the fabric feed amount are designated by two-digit numbers, respectively.

The present invention will be explained with reference to the attached drawing.

DETAILED DESCRIPTION OF THE PREFERRED EMBODIMENTS

Figure 1:
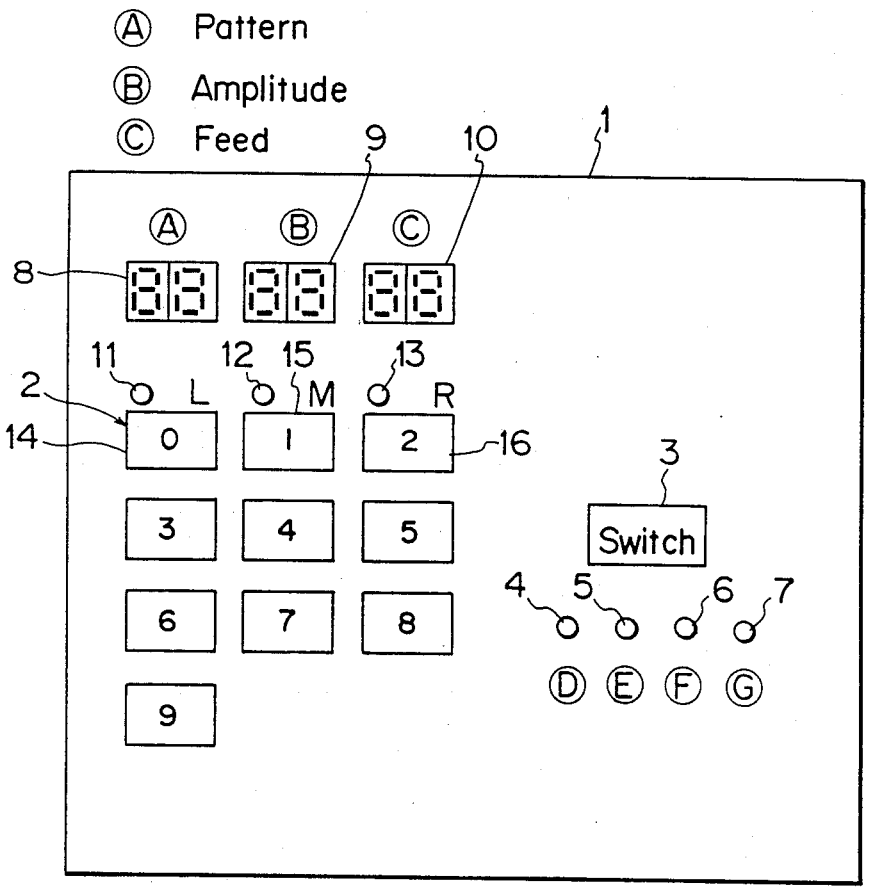
FIG. 1 is a front panel of a sewing machine, showing an embodiment of the invention.

The present invention will be explained in reference to an embodiment shown in the attached drawing. A front panel 1 is provided on a front face of a sewing machine (not shown). A keyboard 2 is used for selecting patterns, and controlling a needle amplitude amount, a fabric feed amount and a basic line of a straight stitching, and it designates them by twice pushing or, for the control of the basic line by once pushing keys with a pattern number. A switch designating key 3 is for switching functions of the keyboard 2 each time of its operations, and is for lighting a lamp 4 of a pattern selection, a lamp 5 of an amplitude setting, a lamp 6 of a feed setting and a lamp 7 of a basic line of a straight stitching.

Each of indicators 8, 9, 10 of seven LED segments corresponds to each of the lamps 4, 5, 6. With respect to items lighted by said lamps, the numbers thereof designated by the keyboard 2 are indicated. While the lamp 7 is lighted, the basic line indicating lamps 11, 12, 13 respectively correspond to a designation key 14 of a specific number 0, a designation key 15 of a specific number 1 and a designation key 16 of a specific number 2. When those keys are pushed, the lamps are lighted to designate a left (L), a middle (M) and a right (R) with respect to the basic line of the straight stitching.

Figure 2:
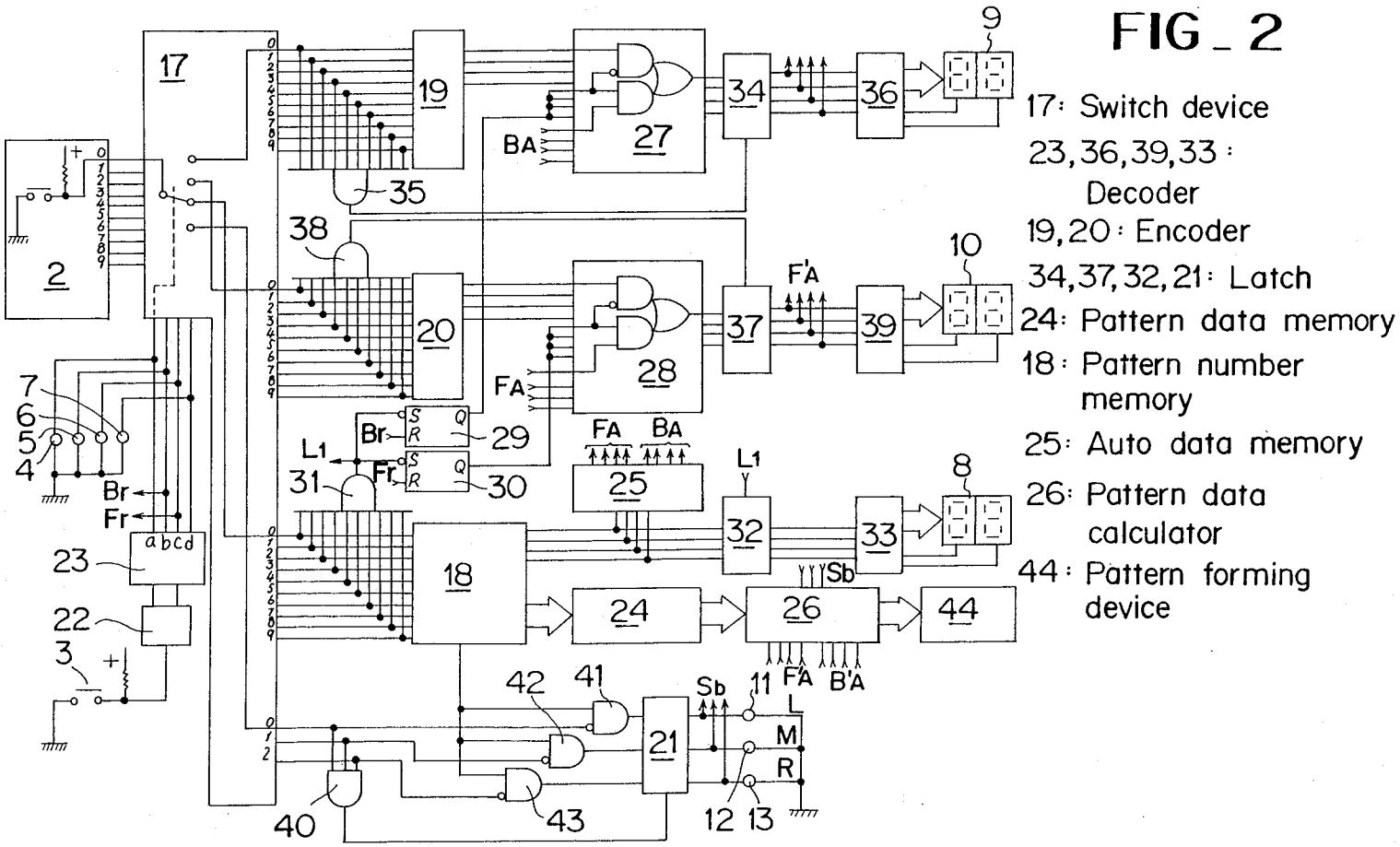
FIG. 2 is a control block diagram.

FIG. 2 is a control block diagram. The keyboard 2 shows representatively one of the ten keys or switches, and an output line is made L level by operation of each of them.

A switching device 17 successively switches, per each of operations of the switch designating key 3, the number designated by the keyboard 2 to a pattern number memory device 18, an encoder 19 for controlling the needle amplitude, an encoder 20 for controlling the fabric feed or a latch 21 for controlling the basic line of the straight stitching.

A counter 22 counts number of actuations of the switch designating key 3, and a decoder 23 decodes the counted values per each of the actuations and outputs H level signals from terminals (a) (b) (c) (d) thereof. The output from the terminal (a) of the decoder 23 gives designation of the numerical value by the keyboard 2 to the pattern number memory device 18, and lights the lamp 4. Similarly, the output from the terminal (b) works the encoder 19 and the lamp 5, and the output from the terminal (c) works the encoder 20 and the lamp 6, and the output from the terminal (d) works the latch 21.

The pattern number memory device 18 designates a data reading-out initial address of the pattern data memory device 24 in accordance with operation of the keyboard 2, and outputs from an auto data memory device 25 auto data BA and FA concerning the amplitude and the feed common to each stitch of said pattern.

The auto data BA and FA control the stitching data from the pattern data memory device 24 in the pattern data computing device 26, and make auto setting values of coefficients for computing the size (mm) of the pattern, while the encoders 19, 20 encode the designation of the numerical values of the keyboard 2 to give them to AND-OR circuits 27, 28.

The encoders 19, 20 receive respectively auto data BA and FA from an auto data memory device 25. The auto data BA of the encoder 19 and the designated data by the keyboard 2 are switched each other by a flip-flop 29. The auto data FA of the encoder 20 and the designated data by the keyboard 2 are switched each other by a flip-flop 30.

The flip-flops 29, 30 are set by supplying a control power source, or are set by receiving L level signal at set terminals (S) via AND circuit 31 when a pattern number memory device 18 receives an operation signal of the keyboard 2. At this time, outputs of AND-OR circuits 27, 28 are made auto data BA and FA respectively by the outputs Q, and when the terminal (b) of the decoder 23 is H level, the flip-flop 29 receives H level signal at a reset terminal (R) and is reset, or when the terminal (c) is H level, the flip-flop 30 is similarly reset, and at this time the outputs of AND-OR circuits 27, 28 are switched to values of the encoders 19, 20.

When the pattern is selected, the latch 32 receives a signal $L_1$ of AND circuit 31, and the pattern number memory device 18 issues an output and it latches the pattern number and causes the decoder 33 to show it on the indicator 8.

When the terminal (b) of the decoder 23 is H level and the keyboard 2 is operated, the latch 34 receives a latch signal via AND circuit 35 and then latches the output signal in accordance with the designation of the keyboard 2 of AND-OR circuit 27, and causes the decoder 36 to show it on the indicator 9.

When the terminal (c) of the decoder 23 is H level and the keyboard 2 is operated, the latch 37 receives the latch signal via AND circuit 38, and then latches the output signal in accordance with the designation of the keyboard 2 of AND-OR circuit 28 and causes the decoder 39 to show it on the indicator 10.

When a selected pattern is a straight stitch, the terminal (d) of the decoder 23 is H level and when any one of the specific keys 14, 15, 16 is operated the latch receives the latch signal and it latches the data designated then by the keys 14, 15, 16, and lights the basic line indicating lamps 11, 12, 13 in accordance with said designation.

When the pattern number memory device 18 designates the straight stitch, AND circuits 41, 42, 43 are operative and give the designated data then by the keys 14, 15, 16 to the latch 21.

The pattern data counting device 26 receives the signal BA' TA' or Sb of the latch 34, 37 or 21, and counts controlled values of the selected patterns and gives them to the pattern forming device 44.

A reference will next be made to actuation of the above mentioned structure.

When the control power source is supplied, the terminal (a) of the decoder 23 is made H level and an initial resetting is made in such a way that the number 0 is designated by the keyboard 2, so that the straight stitch is selected and the number of the straight stitch is shown in the indicator 8.

The flip-flops 29, 30 are set, and under this condition, the control signals BA', FA' to be input into the pattern data count device 26 are made auto data BA, FA respectively, and the signal BA' sets the central basic line. At this time, the signal Sb is not input.

When the switch designating key 3 is pushed three times in order to designate the left basic line (L) of the straight stitch, the lamp 7 is lighted. When the key 14 of the keyboard 2 is operated under this condition, the latch 21 latches the signal of the left basic line, and the lamp 11 is lighted and the pattern forming device 44 forms the straight stitch of the left basic line.

For selecting another pattern, the switch designating key 3 is pushed once, then the terminal (a) of the decoder 23 is made H level and the pattern selecting lamp 4 is lighted. Under this condition, the keyboard 2 is operated to designate the pattern number of two figures, then this pattern is selected. The control signals BA', FA' to be input into the pattern data count device 26 are made auto data BA, FA. Thus, the numbers set by the signals BA, FA are shown in the indicators 9, 10.

For enlarging or reducing the pattern in size in the amplitude direction, the switch designating key 3 is pushed, then the terminal (b) of the decoder 23 is made H level and the amplitude setting lamp 5 is lighted. The flip-flop 29 is reset, and under this condition, the keyboard 2 is operated to designate a size of the pattern in the needle amplitude direction with a two-digit number, and this number is indicated in the indicator 9 so that a required size is designated. Similarly, if the enlargement or reduction is required in the fabric feed direction, the switch designating key 3 is pushed, then the terminal (c) of the decoder 23 is made H level, and the flip-flop 30 is reset. Under this condition, the keyboard 2 is operated to designate the size of the pattern in the fabric feed direction, so that this figure is indicated in the indicator 10 and the size in the fabric feed direction is designated.

As mentioned above, depending upon the present invention, the size of the pattern may be controlled rapidly and finely by an easy operation. Since the keyboard 2 may be used in common with respect to the different functions, the space for the operating part in the panel may be reduced relatively.

What is claimed is:

1. An electronic sewing maching having a first memory for storing stitch control data including needle position control data and feed amount control data corresponding to a plurality of different patterns, means for selectively reading out said patterns, and a stitch condition setting device comprising:

(a) a board of ten keys selectively operated to produce two-digit pattern number signals each specific to respective patterns stored in said first memory;

(b) a second memory for storing auto setting data (BA), (FA) each specific to respective patterns stored in said first memory;

(c) a third memory responsive to the operation of said keys to temporarily store the pattern number signals selected by said keys, said third memory addressing said first and second memories with said selected pattern number signals to read out the auto-data and the stitch control data specific to the selected patterns;

(d) calculating means cooperating with said first and second memories to perform calculations with the read out stitch control data and auto-data and to produce calculated stitch control data for standardizing the selected patterns;

(e) a single switchover key repeatedly activated to change the pattern selecting function of said board of ten keys to another function for modifying the stitches of the selected patterns;

(f) switchover means;

(g) a counter operated in response to each activation of said switchover key to activate said switchover means, accordingly; said switchover means being activated in response to each operation of said counter to change an activation state thereof; and (h) data changeover means being responsive to a first activation of said switchover means to make effective the number signals produced by a selective activation of said ten keys for modification of the selected patterns, said signals being applied to said calculating means and subjected to calculations with said calculated stitch control data for standardizing the selected patterns, to produce modified stitch control data for modifying a needle position of the selected pattern, said changeover means being responsive to a second activation of said switchover means to make effective said number signals, said signals being applied to said calculating means and subjected to calculations with said calculated stitch control data for standardizing the selected patterns, to produce modified stitch control data for modifying the feed amount of the selected pattern.

2. An electronic sewing machine as defined in claim 1, wherein said data changeover means includes a first data changeover circuit operated in response to said first activation of said switchover means so as to produce said modified stitch control data for modifying the needle position of the selected pattern; and a second data changeover circuit operated in response to said second activation of said switchover means so as to produce said modified stitch control data for modifying the feed amount of the selected pattern.

3. An electronic sewing machine as defined in claim 2, wherein said first memory stores stitch control data for a straight stitch selected by selective operation of said ten keys, and said ten keys including at least three function keys for producing at least three different signals designating different needle positions for said straight stitch.

4. An electronic sewing machine as defined in claim 3, further comprising a control circuit responsive to a third activation of said switchover key to make effective one of said three needle position designating signals produced when said three function keys are selectively operated, an effective needle position designating signal being applied to said calculating means, the latter being simultaneously operated to make calculation with said needle position designating signal and the calculated stitch control data for said straight stitch to produce modified stitch control data determining the selected needle position of said straight stitch.

5. An electronic sewing machine as defined in claim 4, further comprising a first display electrically connected to said third memory, said first display being operated in response to writing a pattern number signal into said third memory to display the corresponding pattern number.

6. An electronic sewing machine as defined in claim 2, further comprising a second display electrically connected to said first data changeover circuit, said first data changeover circuit normally making effective first auto-data BA of said second memory, each specific to said needle position control data of said first memory, and representing standardization values of the selected patterns, said second display being operated in response to the selective operation of said ten keys to display a two-digit number representing a standardization value as to the needle position of a selected value.

7. An electronic sewing machine as defined in claim 6, wherein said second display is operated in response to selective operation of said ten keys performed after said first activation of said switchover key, to display a two-digit number representing a pattern modification value as to the needle positions of a selected pattern.

8. An electronic sewing machine as defined in claim 2, further comprising a third display electrically connected to said second data changeover circuit, said second data changeover circuit normally making effective second auto data BF of said second memory, each specific to said feed amount control data of said first memory, and representing standardization values of the selected patterns, said third display being operated in response to the selective operation of said ten keys to display a two-digit number corresponding to a pattern standardization value of the feed amounts of a selected pattern.

9. An electronic sewing machine as defined in claim 4, wherein said third display is operated in response to selective operation of said ten keys performed after said second activation of said switchover key to display a two-digit number corresponding to a pattern modification value of the feed amounts of a selected pattern.

* * * * *